US005797219A

United States Patent [19]

Croswell

[11] Patent Number: 5,797,219

[45] Date of Patent: Aug. 25, 1998

[54] CHILDREN'S PLAY GARAGE WITH ARTICULATING DOOR

[76] Inventor: Vonda B. Croswell, 20145 Verta St., Perris, Calif. 92570

[21] Appl. No.: 678,399

[22] Filed: Jul. 2, 1996

[51] Int. Cl.[6] ..... E04B 1/00; A63H 33/08

[52] U.S. Cl. ..... 52/69; 52/592.1; 446/110

[58] Field of Search ..... 446/110, 476, 446/478, 487, 481, 482; 52/69, 592.1, 270, 284, 272; 16/319, 375, 377

[56] References Cited

U.S. PATENT DOCUMENTS

| | | | |
|---|---|---|---|
| 1,828,309 | 10/1931 | Berger | 446/110 X |
| 2,522,160 | 9/1950 | Borchers | 446/423 |
| 3,496,670 | 2/1970 | Sloop et al. | 446/104 |
| 4,227,337 | 10/1980 | Murray et al. | 446/110 X |
| 5,121,710 | 6/1992 | Gonzalez | 446/476 X |

FOREIGN PATENT DOCUMENTS

| | | | |
|---|---|---|---|
| 1098221 | 7/1955 | France | 446/478 |

*Primary Examiner*—Mickey Yu

[57] ABSTRACT

A children's play garage having a plurality of detachably connected walls, a roof, a toy compartment, and an articulating vehicle door is disclosed. The play garage further includes an opening for accessing the toy compartment from the exterior of the play garage. Alternatively, the play garage includes an articulating user door, and window openings in one or more walls, the vehicle door or the user door. The vehicle door is hinged by hinges having polygonal bores and polygonal pins to allow the door to be self-supporting in an open position.

13 Claims, 7 Drawing Sheets

CHILDREN'S PLAY GARAGE WITH ARTICULATING DOOR

FIELD OF THE INVENTION

This invention relates to storage structures and more particularly to a child's play structure which is useful for storing wagons, tricycles and various other children's toys.

BACKGROUND OF THE INVENTION

Play structures have long been constructed for the entertainment and recreation of children, in a variety of shapes and configurations. Some of the common structures include doll houses, play kitchens, tree houses, and the like. These structures stimulate a child's imagination and facilitate roll playing by providing a safe alternative to potentially unsafe adult environments. Further, play structures which accurately resemble the simulated adult environment appear to be more appealing to children.

Play structures can also provide storage for children's toys. For example, U.S. Pat. No. 3,774,357, issued to Clifford J. Moore, teaches the combination of a play garage and a detachable, horizontally mounted toy box which provides horizontal strength and rigidity to the structure.

In addition to storage, it is desirable for outside play structures to provide some degree of protection against weather and at least minimal theft deterrence. One side of the play structure of the Moore patent, however, is left entirely open, and does not provide complete enclosure for stored toys, such as a tricycle.

In designing play structures for children, several features are important and should be considered. First of all the structure should be inherently safe. There should be no sharp or pointed edges and the structure should not create a hazard due to accidental disassembly. Second, the structure should be mechanically strong, capable of reasonable abuse during normal play activity. Third, structures which are intended for outdoor use should be resistant to weather degradation. Fourth, the structure should easily assemble and disassemble for storage, transport, and use. Fifth, the design should present enough creativity to meet the entertainment objectives of its intended purpose.

SUMMARY OF THE INVENTION

A play garage is disclosed which is useful for storing battery powered vehicles, tricycles, wagons and other large toys, and which also provides the stored contents with some measure of protection from weather and theft. The garage of the present invention is also a recreational structure containing doors, shelves, windows, and a toy storage compartment.

The preferred embodiment shown in FIG. 1, is colorfully decorated with decals and appliques both inside and out. The garage is constructed of molded plastic and consists of four walls which connect together using a hook and slot construction mechanism. A one piece roof attaches to the four walls providing structural support for the enclosure. The garage features a hinged door which opens vertically and is held in place by an octagonal pinion and bore mechanism. Alternatively, the door is held in place by including a counterweight at the top of the door or within the pinion bracket. The garage door features windows and a door handle. The right wall of the structure contains a window and window shelf. Below the window shelf is a storage hatch which opens outward from the outside and provides access to an internal toy storage compartment. The open hatch also is useful as a shelf or work space, appropriate for a child to draw or color while being seated on the ground outside the structure. The left wall of the garage contains a hinged door with windows and a latch.

DESCRIPTION OF THE PREFERRED EMBODIMENT

The present invention teaches a novel play garage structure for children. Numerous details are set forth such as construction materials and interconnection methods, but it will be obvious that the invention may be practiced apart from these details. In other instances, details of well known toy manufacturing methods have not been set forth, so as not to obscure the present invention.

Figure 1:
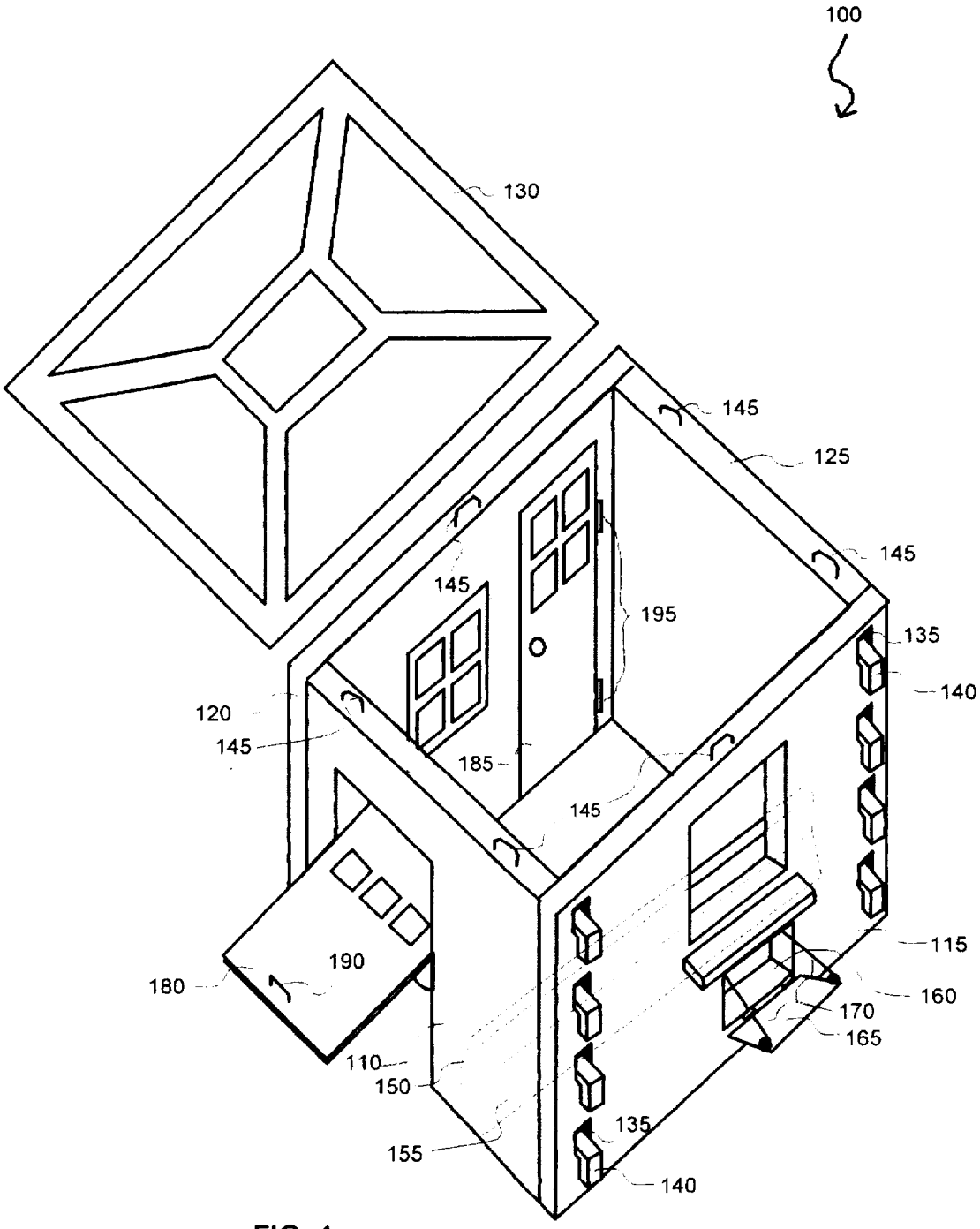
FIG. 1 shows a partially exploded, perspective view of the play garage of the present invention.

FIG. 1 shows a perspective view of the play garage 100 of the present invention. Preferably, garage 100 is constructed of plastic, but those skilled in the art will understand that alternative construction materials may be substituted without departing from the spirit or scope of the invention.

Garage 100 includes a front wall 110, a right wall 115, a left wall 120, a back wall 125, and a roof 130. Right wall 115 and left wall 120 each define a plurality of slots 135, and front wall 110 and back wall 125 each include a corresponding plurality of hooks 140. Hooks 140 engage slots 135 to interconnect right wall 115 and left wall 120 with front wall 110 and back wall 125. The hook/slot interconnection method provides structural strength and ease of assembly. Front wall 110, right wall 115, left wall 120, and back wall 125, each include one or more roof tabs 145 which engage corresponding roof grooves (not shown) to securely mount roof 130 on top of the four interconnected walls 110, 115, 120, and 125. As shown, the preferred roof tabs 145 may also be used as carrying handles.

A vehicle door 180 and a user door 185 provide user access to the interior of play garage 100. Vehicle door 180 is pivotably mounted to front wall 110 such that vehicle door 180 can be opened by grasping a handle 190 and lifting in an upward and outward direction. User door 185 is pivotably connected to left wall 120 by hinges 195.

Play garage 100 also includes a toy compartment partition 150 (shown with dotted lines as hidden) which defines one side of a toy compartment 155, the other sides of toy compartment 155 being defined by portions of front wall 110, right wall 115, and back wall 125. Toy compartment 155 can be accessed from the inside of play garage 100 or from the outside of play garage 100 through portal 160 defined by right wall 115. Portal cover 165 is pivotably connected to right wall 115 and is supported in the open position by support cords 170. When closed, portal cover 165 prevents access to toy compartment 155, and when open provides a flat surface area that children can use for activities such as coloring.

Figure 2A:
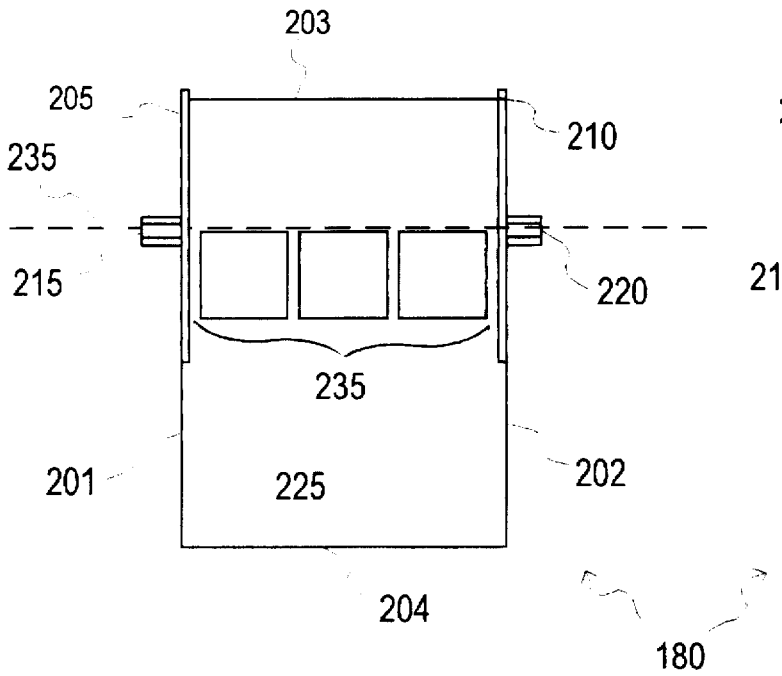
FIG. 2*a* is an inside view showing the vehicle door of the play garage of the present invention.
Figure 2B:
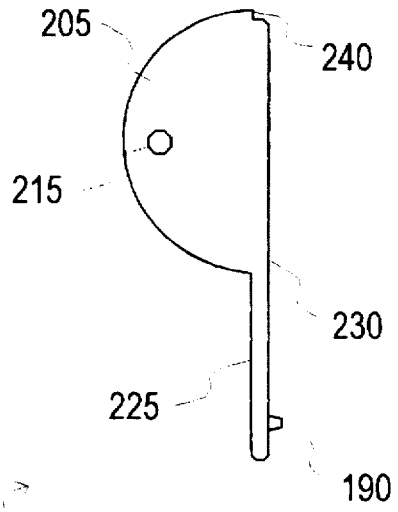
FIG. 2*b* is a side view showing the vehicle door of the play garage of the present invention.

FIGS. 2*a* and 2*b* show an inside view and a side view, respectively, of vehicle door 180, including handle 190, a first lateral edge 201, a second lateral edge 202, a top edge 203, a bottom edge 204, an interior surface 225, an exterior surface 230, a first pinion bracket 205, a second pinion bracket 210, a first octagonal pinion 215, a second octagonal pinion 220, a plurality of windows 235, and a retaining lip 240. First lateral edge 201 is parallel to second lateral edge 202 and perpendicular to top edge 203 and bottom edge 204, such that external surface 230 is substantially rectangular. Windows 235 are empty portals which may optionally be fitted with transparent plastic panels.

First pinion bracket 205 and second pinion bracket 210 extend orthogonally from opposite, lateral edges of interior surface 225. First octagonal pinion 215 and second octagonal pinion 220 are right octagonal cylinders, each having a central axis, which are fixed to and extend laterally from first pinion bracket 205 and second pinion bracket 210 respectively. First octagonal pinion 215 and second octagonal pinion 220 are disposed with their respective central axes colinear with each other, parallel to top edge 203 and a spaced distance from interior surface 225. Preferably, vehicle door 180 is manufactured as a single piece of durable plastic, but it should be obvious that the components of vehicle door 180 could be manufactured separately and assembled by an alternative method, such as with screws or nuts and bolts.

Figure 3A:
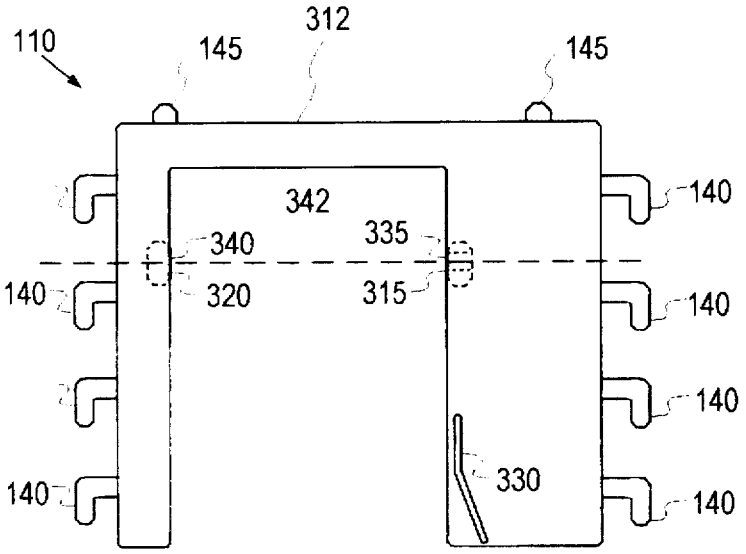
FIG. 3*a* is an outside view showing the front wall of the play garage of the present invention.
Figure 3B:
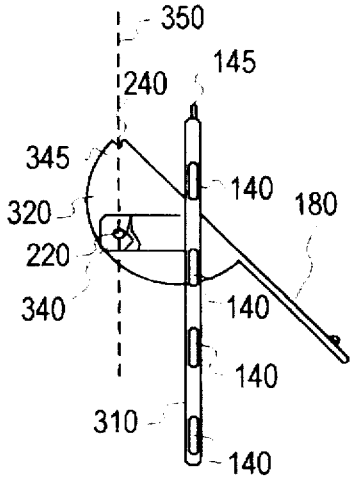
FIG. 3*b* is a side view showing the vehicle door mounted to the front wall in a partially open position.

FIGS. 3*a* and 3*b* show a front view of front wall 110 and a side view of front wall 110 with vehicle door 180 mounted thereon, respectively. Front wall 110 includes exterior surface 305, interior surface 310, top edge 312, first door support arm 315, second door support arm 320, vehicle opening 325, and front partition receiving slot 330. Front partition receiving slot 330 receives the front end of and provides support for toy compartment partition 150.

Vehicle opening 325 is large enough to facilitate ingress and egress of larger toys, such as tricycles and other riding toys. First door support arm 315 and second door support arm 320 extend orthogonally from interior surface 310. First door support arm 315 defines a first octagonal bore 335, having a central axis, near its distal end. Second door support arm 320 also defines a second octagonal bore 340, having a central axis, near its distal end. First octagonal bore 335 and second octagonal bore 340 are disposed with their respective central axes colinear with each other, parallel to top edge 312 and a spaced distance from interior surface 305.

Vehicle door 180 is mounted to front wall 110 through a coupling of octagonal pinions 215 and 220 with octagonal bores 335 and 340. Door support arms 315 and 320, which define octagonal bores 335 and 340, are constructed of a stiff elastic plastic which distorts slightly to allow pinions 215 and 220 to rotate with some friction within octagonal bores 335 and 340. The friction between pinions 215 and 220 and the walls of octagonal bores 335 and 340 is sufficiently weak to permit vehicle door 180 to open when lifted by door handle 16, but strong enough to prevent door 180 from closing due to its own weight.

Alternatively, vehicle door 180 may include a counter weight 345, and circular cylindrical pinions and bores. In such an embodiment, the friction between the pinions and hubs is minimal. Counter weight 345 biases door 180 to either the open position or the closed position depending on the location of counter weight 345 relative to a vertical plane 350 passing through the centers of pinions 215 and 220. If counter weight 345 is located on the front wall 310 side of vertical plane 350, counter weight 345 urges door 180 to a closed position, biasing retaining lip 240 against interior surface 310 of front wall 110. On the other hand, if counter weight 345 is on the side of vertical plane 350 away from front wall 310, counter weight 345 urges door 180 to an open position, biasing exterior surface 230 of vehicle door 180 against the top edge of vehicle opening 325.

Figure 4:
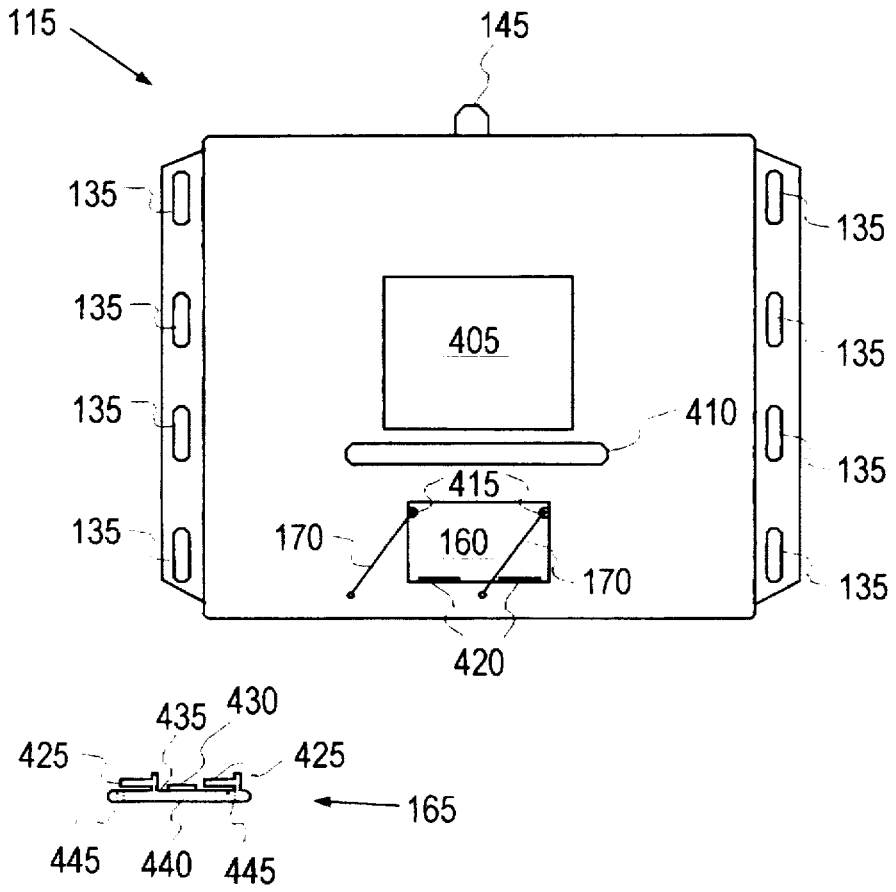
FIG. 4 is an outside view showing the right wall and the detached portal hatch of the play garage of the present invention.

FIG. 4 shows an outside view of right wall 115 and detached portal cover 165. Right wall 115 includes window opening 405, window shelf 410, proximal support cord attachments 415, and hinge pin receivers 420. Portal cover 165 includes cylindrical hinge pins 425 latch 430 inside surface 435, outside surface 440, and distal support cord attachments 445. Window opening 405 allows children located inside play garage 100 to see out, and supervising adults located outside play garage 100 to see in. Preferably, window opening 405 is simply a rectangular opening in right wall 110, but alternatively window opening 405 can be fitted with a transparent insert to provide increased protection against the elements. Window shelf 410 serves the multiple purposes of providing a bottom frame to window opening 405, providing a play surface for drawing and writing, and serving as a storage shelf.

Proximal support cord attachments 415 are connected to right wall 110 inside and near the top of each side of portal 160. Proximal support cord attachments provide a means for connecting the proximal ends of support cords 170 to right wall 110. Hinge pin receivers 420 are cylindrical shells, and are attached to right wall 110 near the bottom of portal 160, with their central axes running parallel to the bottom edge of portal 160. Preferably, right wall 110 is manufactured as a single piece of durable plastic, but it should be obvious that proximal support cord attachments 415 and hinge pin receivers 420 could be manufactured separately and mounted to right wall 110 by some conventional method such as with screws or nuts and bolts.

Portal cover 165 is mounted to right wall 100 by inserting hinge pins 425 into hinge pin receivers 420, such that the central axes of hinge pins 425 are coincident with the central axes of hinge pin receivers 420. Thus mounted, portal cover 165 can be rotated between open and closed positions, about the central axes of hinge pins 425. Latch 430 protrudes slightly from the top interior surface of portal cover 165 and frictionally engages the top edge of portal 160 when portal cover 165 is in the closed position, thus retaining portal cover 165 in the closed position until a user exerts sufficient outward force to open it. Distal support cord attachments 445 are disposed near the top, outer edges of portal hatch 165, and engage the distal ends of support cords 170. Preferably, distal support cord attachments 445 are openings passing through portal hatch 165, orthogonal to interior surface 435 and having diameters slightly larger than support cords 170. Support cords 170 pass from the interior surface 435 of portal cover 165, though distal support cord attachments 445, to the exterior of portal cover 165. The ends of support cords 170 are knotted to engage and support portal cover 165, when open, in a position parallel to the floor or surface upon which play garage 100 rests, such that interior surface 435 of portal cover 165 can be used as a writing surface or flat crafts or play surface.

Figure 5:
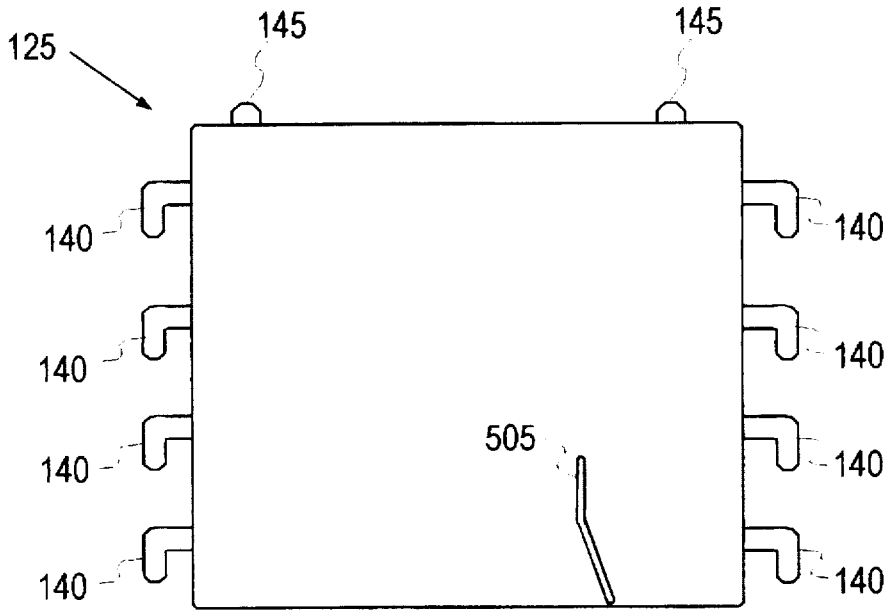
FIG. 5 is an inside view showing the back wall of the play garage of the present invention.

FIG. 5 shows an inside view of back wall 125, including back partition receiving slot 505. Back partition receiving slot receives the back end of and provides support for toy compartment partition 150. When the front and back ends of toy compartment partition 150 are engaged in front and back receiving slots 330 and 505 respectively, front wall 110 and back wall 125 hold toy compartment partition 150 in place, thereby creating toy compartment 155 between front wall 110, right wall 115, back wall 125, and toy partition 150.

Figure 6:
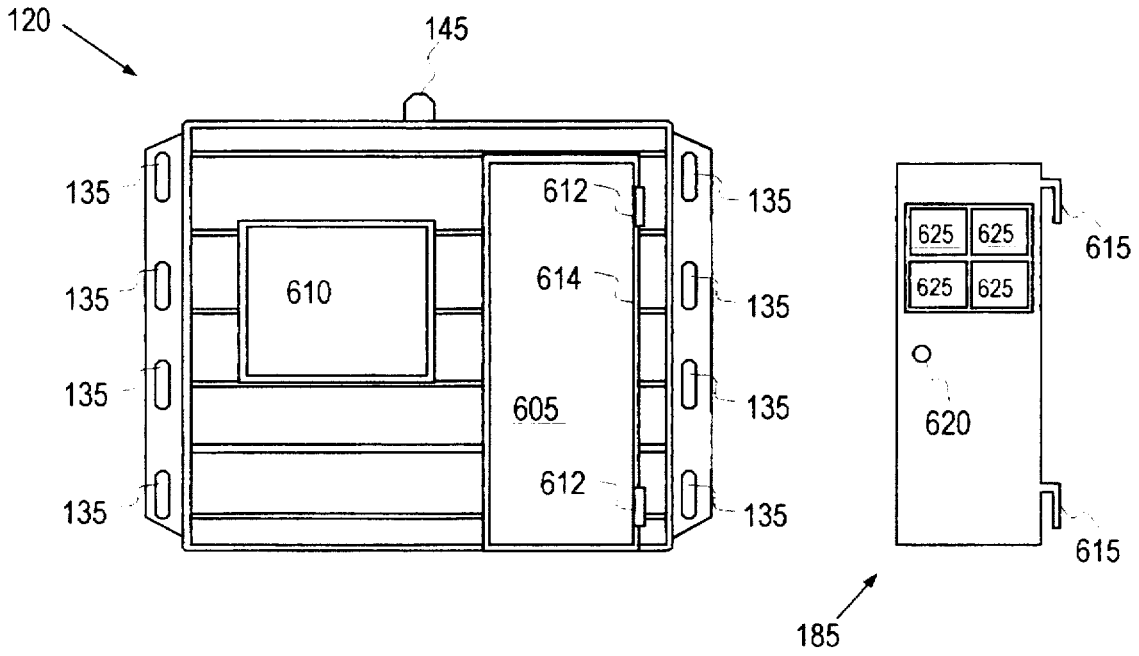
FIG. 6 is an inside view showing the left wall and detached user door of the play garage of the present invention.
Figure 7C:
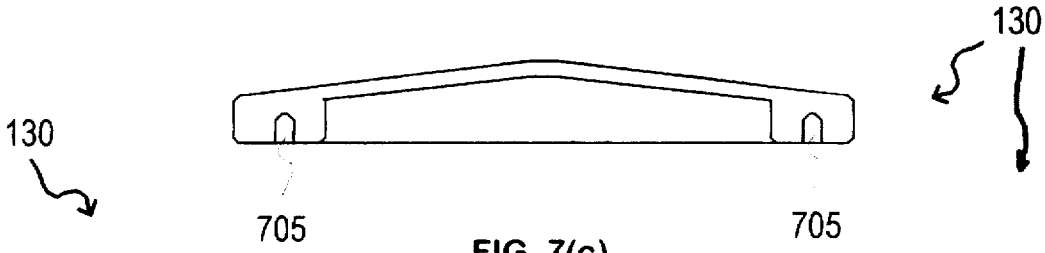
FIGS. 7 *a–c* are top plan, bottom plan, and vertical cross-sectional views, respectively, of the roof of the play garage of the present invention.
Figure 7A:
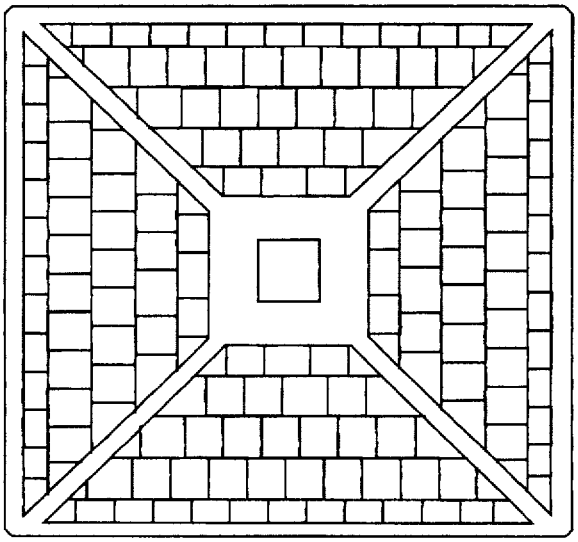
Figure 7B:
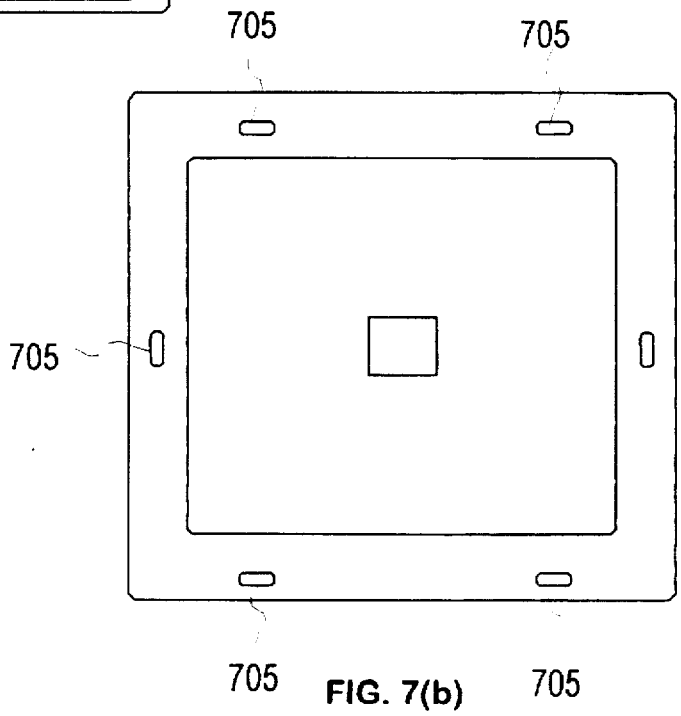

FIG. 6 shows an inside view of left wall 120 and detached user door 185. Left wall 120 includes user door opening 605, window opening 610 and hinge pin receivers 612. User door opening 605 provides ingress and egress to and from the interior of play garage 100. Window opening 610 allows children inside play garage 100 to see out, and supervising adults to see in. Preferably, window opening 610 is simply a rectangular opening in right wall 110, but alternatively window opening 405 can be fitted with a transparent insert to provide increased protection against the elements. Hinge pin receivers 612 are cylindrical shells, and are attached to left wall 120 near the hinge edge 614 of user door opening 605, with their central axes running parallel to hinge edge 614 of user door opening 605. Preferably, left wall 120 is manufactured as a single piece of durable plastic, but it should be obvious that hinge pin receivers 612 could be manufactured separately and mounted to left wall 120 by some conventional method such as with screws or nuts and bolts.

User door 185 includes hinge pins 615, door knob 620, and window openings 625. User door 185 is mounted to left wall 120 by inserting hinge pins 615 into hinge pin receivers 612, such that the central axes of hinge pins 615 are coincident with the central axes of hinge pin receivers 612. Thus mounted, a child can grasp door knob 620 and swing user door 185 between open and closed positions, about the central axes of hinge pins 615. Preferably, window openings 625 are simply rectangular openings in user door 185, but alternatively window openings 625 can be fitted with a transparent inserts to provide increased protection against the elements. In a preferred embodiment, user door 185 is manufactured as a single piece of durable plastic, but it should be obvious that hinge pins 615 could be manufactured separately and mounted to user door 185 by some conventional method such as with screws or nuts and bolts.

FIGS. *7a–c* show a top plan view, a bottom plan view, and a vertical cross section of roof 130, including a plurality of roof grooves 705. Roof grooves 705 frictionally engage roof tabs 145 of front wall 110, right wall 115, left wall 120, and back wall 125, to hold roof 130 securely on top of walls 110, 115, 120, and 125. In addition to providing shade, security, and weather protection to the inside of play garage 100, roof 130 also provides structural support.

While the present invention has been described with reference to a certain preferred embodiment, those skilled in the art will recognize that certain described features of the present invention can be altered, substituted or omitted without departing from the spirit and scope of the invention. For example, the number of walls may be increased or decreased. Alternatively, the roof may be omitted by interlocking triangular shaped walls into a pyramid shaped structure. In addition, various known latching mechanisms may be employed to secure the vehicle door or the user door. Further, known interlocking methods, for example tongue and groove, may be employed to join the walls and/or the roof. Therefore, the present invention is limited only by the following claims.

I claim:

1. A play garage comprising:

a plurality of walls, each having a top and two sides, the sides of said walls being interconnected to define an enclosed area, including a first wall which defines an opening to said area;

a roof connected to said tops of said walls which, together with said walls, defines an interior and an exterior of said play garage; and an articulating vehicle door having a door connection to said first wall and capable of transition between an open and a closed position, for covering at least a portion of said opening when in the closed position and for allowing access to said interior when in the open position, said door connection comprising a vehicle door pinion having a polygonal cylinder and said first wall defining a polygonal bore of slightly larger dimension than said pinion for receiving said pinion such that said pinion is not freely rotatable within said bore, but can be rotated by applying an external force to said vehicle door.

2. The play garage of claim 1 wherein said pinion comprises an octagonal cylinder and said bore comprises an octagonal bore.

3. The play garage of claim 1 comprising large dimensions that allows access by a plurality of children and for storage purposes.

4. The play garage of claim 1 further comprising a partition defining a toy compartment between said partition and at least one said walls within said interior of said play garage.

5. The play garage of claim 4 wherein at least one said walls defines an access opening for accessing said toy compartment from the exterior of said play garage.

6. The play garage of claim 1 wherein said walls are detachably interconnected for providing easy user assembly and disassembly.

7. The play garage of claim 6 wherein a first group of said walls define slots and a second group of said walls comprise hooks for engaging said slots of said first group of said walls, for detachably connecting said walls of said first group to said walls of said second group.

8. The play garage of claim 1, wherein at least one of said walls defines a user opening for providing user ingress and egress to and from said toy garage.

9. The play garage of claim 1, further comprising a user door pivotably connected to one of said walls and capable of transition between an open and a closed position, for covering at least a portion of said user opening when in the closed position and allowing access to said interior through said user opening when in the open position.

10. The play garage of claim 9, wherein said user door comprises at least one cylindrical hinge pin, and said wall to which said user door is pivotably connected comprises at least one hinge pin receiver for receiving said hinge pin, providing support for said user door, and facilitating the rotation of said user door about said hinge pin between said open and said closed positions.

11. The play garage of claim 9 wherein said user door defines at least one window opening.

12. The play garage of claim 1 wherein said vehicle door defines at least one window opening.

13. The play garage of claim 1 wherein at least one of said walls defines at least one window opening.

* * * * *